US005478502A

United States Patent [19]

Swift

[11] Patent Number: 5,478,502

[45] Date of Patent: Dec. 26, 1995

[54] GRANULAR DETERGENT COMPOSITION CONTAINING HYDROTROPES AND OPTIMUM LEVELS OF ANOIONIC SURFACTANTS FOR IMPROVED SOLUBILITY IN COLD TEMPERATURE LAUNDERING SOLUTIONS

[75] Inventor: Ronald A. Swift, Cincinnati, Ohio

[73] Assignee: The Procter & Gamble Company, Cincinnati, Ohio

[21] Appl. No.: 203,287

[22] Filed: Feb. 28, 1994

[51] Int. Cl.[6] ..... C11D 1/12; C11D 1/37; C11D 1/65

[52] U.S. Cl. ..... 252/549; 252/530; 252/532; 252/535; 252/539; 252/529; 252/548; 252/551; 252/554; 252/558; 252/174.14

[58] Field of Search ..... 252/549, 550, 252/551, 553, 554, 558, 556, 548, 94, 95, 530, 532, 535, 539, 529

[56] References Cited

U.S. PATENT DOCUMENTS

| | | | |
|---|---|---|---|
| 3,328,314 | 6/1967 | Marquis | 252/383 |
| 3,332,879 | 7/1967 | Coward et al. | 252/152 |
| 3,424,690 | 1/1969 | Marquis | 252/137 |
| 3,764,569 | 10/1973 | Ali et al. | 252/554 |
| 3,784,475 | 1/1974 | Diehl | 252/89 |
| 3,915,903 | 10/1975 | Wise | 252/552 |
| 3,926,827 | 12/1975 | Mangeli | 252/99 |
| 4,071,476 | 1/1978 | Patterson | 252/557 |
| 4,081,462 | 3/1978 | Powers et al. | 260/501.1 |
| 4,256,597 | 3/1981 | Sakkab | 252/99 |
| 4,256,598 | 3/1981 | Sakkab | 252/99 |
| 4,528,144 | 7/1985 | Gutierrez et al. | 260/503 |
| 4,623,483 | 11/1986 | Lamberti et al. | 252/545 |
| 4,689,167 | 8/1987 | Collins et al. | 252/95 |
| 4,929,379 | 5/1990 | Oldenburg et al. | 252/109 |
| 5,078,916 | 1/1992 | Kok et al. | 252/549 |
| 5,244,593 | 9/1993 | Roselle et al. | 252/99 |

FOREIGN PATENT DOCUMENTS

| | | | |
|---|---|---|---|
| 1292805 | 10/1972 | United Kingdom | C11D 7/42 |
| 1326353 | 8/1973 | United Kingdom | C11D 7/42 |
| 2158087 | 11/1985 | United Kingdom | C11D 10/00 |

*Primary Examiner*—Paul Lieberman
*Assistant Examiner*—Lorna M. Douyon
*Attorney, Agent, or Firm*—Ken K. Patel; J. C. Rasser; J. J. Yetter

[57] ABSTRACT

A detergent composition in form of agglomerates is provided. The detergent composition contains from about 1% to about 50% by weight of a detersive surfactant system. The surfactant system itself includes, by weight of the surfactant system, at least about 30% of a sulfated surfactant selected from alkyl sulfates, alkyl ethoxy sulfates, secondary alkyl sulfates and mixtures thereof. The detergent includes from about 1% to about 50% of a hydrotrope selected from the group consisting of sulfyl succinates, xylene sulfonates, cumene sulfonates and mixtures thereof. Also, the detergent composition includes at least about 1% by weight of a detergency builder to enhance cleaning. The surfactant system, hydrotrope and builder are agglomerated to form detergent agglomerates which are substantially free of phosphates. The anionic surfactants in the detergent composition have significantly improved dissolution in aqueous laundering solutions, especially those kept at cold temperatures, i.e. 5° C. to 30° C.

10 Claims, No Drawings

GRANULAR DETERGENT COMPOSITION CONTAINING HYDROTROPES AND OPTIMUM LEVELS OF ANOIONIC SURFACTANTS FOR IMPROVED SOLUBILITY IN COLD TEMPERATURE LAUNDERING SOLUTIONS

FIELD OF THE INVENTION

The present invention is generally directed to a granular detergent composition having improved solubility in cold temperature laundering solutions. More particularly, the invention is directed to a detergent composition containing high levels of a sulfated surfactant selected from the group consisting of alkyl sulfates (also referenced herein as "AS"), alkyl ethoxy sulfates (also referenced herein as "AES"), and secondary alkyl sulfates (also referenced herein as "SAS") and mixtures thereof, and a hydrotrope selected from the group consisting of sulfyl succinates, xylene sulfonates, cumene sulfonates and mixtures thereof, together which improve solubility in cold temperature washing solutions (e.g. 5° C. to 30° C.) and high water hardness conditions (e.g. 7 grains/gallon). For purposes or producing a high density, compact detergent composition, the detergent of the invention is in the form of detergent agglomerates rather than spray dried granules.

BACKGROUND OF THE INVENTION

Typically, conventional detergent compositions contain mixtures of various surfactants in order to remove a wide variety of soils and stains from surfaces. For example, various anionic surfactants, especially the alkyl benzene sulfonates, are useful for removing particulate soils, and various nonionic surfactants, such as the alkyl ethoxylates and alkylphenol ethoxylates, are useful for removing greasy soils.

While the art is replete with a wide variety of surfactants for those skilled in the art of detergent formulation, most of the available surfactants are specialty chemicals which are not suitable for routine use in low cost items such as home laundering compositions. The fact remains that many home-use laundry detergents still comprise one or more of the conventional alkyl benzene sulfonates or primary alkyl sulfate surfactants. Another class of surfactants which has found use in various compositions where emulsification is desired comprises the secondary alkyl sulfates. The conventional secondary alkyl sulfate surfactants are available as generally pasty, random mixtures of sulfated linear and/or partially branched alkanes.

For example, Rossall et al, U.S. Pat. No. 4,235,752, disclose a detergent surfactant which is a $C_{10-18}$ secondary alkyl sulfate containing 50% of ⅔ sulfate isomers and 40% of various other effective isomers. The surfactant materials disclosed by Rossall et al is for use primarily in dishwashing operations. Such materials have not come into widespread use in laundry detergents, since they do not offer any advantages over alkyl benzene sulfonates, especially with respect to water solubility which facilitates production of high-surfactant granular detergents. Accordingly, Rossall et al do not provide a high density laundry detergent having improved solubility in either cold temperature wash solutions or high hardness water conditions.

The limited solubility of alkyl sulfate surfactants including both primary and secondary alkyl sulfates is especially prevalent in modern granular laundry detergents which are typically used in cold temperature (e.g. 5° C. to 30° C.) washing solutions and are formulated in "condensed" or "compact" form for low dosage usage. For the consumer, the smaller package size attendant with compact detergent products provides for easy storage and handling. For the manufacturer, unit storage costs, shipping costs and packaging costs are lowered.

The manufacture of acceptable compact or condensed granular detergents has its difficulties. In a typical compact detergent formulation, the so-called "inert" ingredients such as sodium sulfate are substantially eliminated. However, such ingredients do play a role in enhancing solubility of conventional detergents. As a consequence, compact detergents often suffer from solubility problems, especially in cold temperature laundering solutions. Moreover, conventional compact or low density detergent granules are usually prepared by spray drying processes which result in extremely porous detergent particles that are quite amenable to being dissolved in aqueous washing solutions. By contrast, compact detergents are typically comprised of less porous, high density detergent particles which are less soluble, e.g. agglomerates. Thus, since the compact form of granular detergents typically comprise particles or granules which contain high levels of detersive ingredients with little or no room for solubilizing agents, and since such particles are intentionally manufactured at high bulk densities, the net result can be a substantial problem with regard to in-use solubility.

In the art of detergency, the use of hydrotropes have generally been associated with liquid detergent compositions to increase the solubility of various detergent ingredients in the composition. For example, Gutierrez et al, U.S. Pat. No. 4,528,144 (Lever), is directed to a liquid detergent compositions containing terpene sulfonate hydrotropes and various other detergent ingredients. In a similar fashion, Lamberti et al, U.S. Pat. No. 4,623,483 (Lever), is also directed to a liquid detergent composition comprising a hydrotrope and other conventional detergent ingredients. Both of the Lamberti et al and Gutierrez patents only suggest liquid compositions and are silent with respect to granular or agglomerated versions of the detergent disclosed therein. Thus, these patents do not speak to the solubility problem associated with cold temperature laundering solutions, a problem particularly prevalent when using detergents which are not spray-dried.

Accordingly, despite the disclosures in the art, there remains a need for a detergent composition which has improved solubility, especially in cold temperature washing solutions. This need is especially prevalent in the art of compact or high density detergents currently being used by consumers. There is also a need for such a detergent composition which also has improved solubility under high water hardness conditions. Also, there is a need for such a detergent composition which exhibits improved biodegradability.

SUMMARY OF THE INVENTION

The present invention meets the needs identified above by providing a detergent composition in the form of agglomerates which exhibit improved solubility or dissolution of the anionic surfactants in cold temperature washing solutions as well as under high water hardness conditions. The detergent composition comprises a surfactant system having a high level of a sulfated surfactant selected from the group of alkyl sulfates, alkyl ethoxy sulfates, secondary alkyl sulfates and mixtures thereof, in combination with a hydrotrope selected from the group consisting of sulfyl succinates, xylene sulfonates, cumene sulfonates and mixtures thereof.

Other adjunct detergent ingredients may also be included in the detergent agglomerates which form the detergent composition. For example, high active (high surfactant levels) particles may be optionally included to enhance cleaning. For purposes of enhancing biodegradability, the detergent composition does not contain any phosphates.

As used herein, the phrase "improved solubility" means that the solubility of the anionic surfactants of the detergent composition is enhanced by at least 5% in the laundering solution when employed in the manner of this invention, as compared to the solubility of the same anionic surfactants per se, under the same test conditions (i.e. water temperature and pH, stirring speed and time, particle size, water hardness, and the like). As used herein, the term "agglomerates" refers to particles formed by agglomerating particles which typically have a smaller mean particle size than the formed agglomerates. All percentages, ratios and proportions used herein are by weight, unless otherwise specified. All documents including patents and publications cited herein are incorporated herein by reference.

In accordance with one aspect of the invention, a detergent composition in the form of agglomerates is provided herein. The detergent composition comprises from about 1% to 50% by weight of a detersive surfactant system. The surfactant system itself comprises, by weight of the surfactant system, at least about 30% of a sulfated surfactant selected from the group consisting of alkyl sulfates, alkyl ethoxy sulfates, secondary alkyl sulfates and mixtures thereof. The detergent composition includes from about 1% to about 50% of a hydrotrope selected from the group consisting of sulfyl succinates, xylene sulfonates, cumene sulfonates and mixtures thereof. Also, the detergent composition includes at least about 1% by weight of a detergency builder to enhance cleaning. The surfactant system, hydrotrope, and builder are agglomerated to form detergent agglomerates which are substantially free of phosphates. The anionic surfactants in the detergent composition have improved solubility in an aqueous laundering solution. Thus, the solubility of the sulfated surfactant (AS, AES and/or SAS) is enhanced by at least 5%, preferably 10 to 50%, over those same surfactants alone under the same test conditions in aqueous washing solutions at cold temperatures, i.e. 5° C. to 30° C.

In accordance with another aspect of the invention, a method for laundering soiled fabrics is provided. The method comprises the step of contacting soiled fabrics with an effective amount of a detergent composition as described herein in an aqueous laundering solution. An effective amount is typically on the order of 1000 to 1500 ppm.

Accordingly, it is an object of the present invention to provide a granular detergent composition which has improved solubility, especially in cold temperature washing solutions. It is also an object of the invention to provide such a detergent composition which has improved biodegradability. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

The invention is directed to a granular detergent composition having improved solubility in cold temperature laundering solutions. A multitude of consumers around the world launder soiled clothes in conventional washing machines unique to their particular geographic location. Typically, these conventional washing machines launder the soiled clothes in water supplied at relatively cold temperatures, for example in range of 5° C. to 30° C., and at high hardness concentrations, e.g. 7 grains/gallon (rich with Ca and Mg ions). Most of the modern day consumers also use compact or condensed laundry detergents to accomplish their laundering needs. Under the aforementioned conditions, solubility of current detergents in aqueous laundering solutions has been a problem. This problem is especially exacerbated when the detergent composition has high levels of alkyl sulfates, alkyl ethoxy, sulfate and/or secondary alkyl sulfates which are not particularly amenable to dissolution in cold aqueous laundering solutions. Such surfactants are particularly useful in modern laundry detergents since they minimize or eliminate the need for linear alkylbenzene sulfate surfactants which generally have poor biodegradability.

It has been found that the solubility of a high-content alkyl sulfate, alkyl ethoxy sulfate and/or secondary alkyl sulfate ("sulfated" surfactant system) detergent composition can be increased by incorporating a hydrotrope selected from the group consisting of sulfyl succinates, xylene sulfonates, cumene sulfonates and mixtures thereof. To that end, the preferred detergent composition of the invention comprises from about 1% to about 50%, preferably from about 15% to about 40%, by weight of a hydrotrope. The surfactant system of the detergent composition comprises at least 30%, preferably from about 35% to about 90%, of a sulfated surfactant selected from the group consisting of alkyl sulfates, alkyl ethoxy sulfates, secondary alkyl sulfates and mixtures thereof. Preferably, the detergent composition is in the form of agglomerates and has an overall density of 650 g/l or higher. It has been found that such a detergent composition containing agglomerates having the aforementioned surfactant system and hydrotrope surprisingly has significantly improved solubility in cold temperature (5° C. to 30° C.) washing solutions as well as under high water hardness conditions.

Preferably, the detergent composition of the invention also comprises at least about 1%, preferably from about 10% to about 40%, of a detergency builder. The detergent composition may also include one or more of adjunct detergent ingredients. Nonlimiting examples of the detergency builder and such adjunct ingredients are described in detail hereinafter. Preferably, the detergent composition herein is formulated and processed to achieve a density of at least 650 g/l for purposes of producing a "compact" detergent product.

For purposes of enhancing biodegradability, the detergent agglomerates which form the detergent composition of the invention preferably do not contain phosphates. Further, it is important for the detergent composition to be in the form of "agglomerates" as opposed to spray dried granules. This is particularly important since most sulfated surfactants cannot be readily subjected to spray drying processes without causing or creating extremely adverse plumes from the spray drying towers.

The "improved solubility" achieved by the detergent composition is concerned with enhanced solubility of the anionic surfactants contained in the surfactant system, i.e. AS, AES, SAS or LAS if used. Preferably, the improvement represents at least a 5% increase in solubility of these anionics in the wash solution over the solubility of the same surfactants if they were dissolved alone or without being contained in a detergent composition as defined herein. More preferably, the solubility improvement is from about 10% to about 50%. As those skilled in the art will appreciate, any comparison of anionic surfactant solubility should be completed tinder the same laundering conditions, e.g. water temperature, hardness and pH, stirring speed and time, and particle size. Typical anionic surfactant solubility improvements are set forth in the Examples hereinafter.

Those skilled in the art should also appreciate the numerous ways in which the amount of the surfactant system in the washing solution can be determined. For example, in the so-called "cat$SO_3$" titration technique, samples of the aqueous laundering solution containing the detergent composition can be taken after one minute and filtered with 0.45 mm nylon filter HPLC, after which the filtered solution can be titrated with a cationic titrant, which can be commercially purchased, e.g. from Sigma Chemical Company under the trade name Hyamine, in the presence of anionic dyes. From the foregoing, the amount of anionic surfactant which was dissolved in the washing solution can be determined.

Surfactant System

The surfactant system in the detergent composition must include a sulfated surfactant selected from the group consisting of alkyl sulfates, alkyl ethoxy sulfates, secondary alkyl sulfates, and mixtures thereof. As mentioned previously, the anionic surfactants in the surfactant system of the invention, i.e. AS, AES, and/or SAS, have improved solubility and more particularly, on the order of 5% or higher. Optionally, the surfactant system may contain one or more of additional surfactants, nonlimiting examples of which are provided hereinafter.

The surfactant system preferably includes conventional primary alkyl sulfate surfactants have the general formula $$ROSO_3^-M^+$$

wherein R is typically a linear $C_{10}$–$C_{20}$ hydrocarbyl group and M is a water-solubilizing cation. Branched-chain primary alkyl sulfate surfactants (i.e., branched-chain "PAS") having 10–20 carbon atoms can also be used herein; see, for example, European Patent Application 439,316, Smith et al, filed 21.01.91, the disclosure of which is incorporated herein by reference (Included in the term "alkyl" is the alkyl portion of acyl groups). Included in the surfactant system are the $C_{10}$–$C_{18}$ alkyl alkoxy sulfates ("$AE_xS$"; especially EO 1–7 ethoxy sulfates).

Conventional secondary alkyl sulfate surfactants can also be used herein and include those materials which have the sulfate moiety distributed randomly along the hydrocarbyl "backbone" of the molecule. Such materials may be depicted by the structure $$CH_3(CH_2)_n(CHOSO_3^-M^+)(CH_2)_mCH_3$$

wherein m and n are integers of 2 or greater and the sum of m+n is typically about 9 to 17, and M is a water-solubilizing cation.

More preferably, a selected secondary (2,3) alkyl sulfate surfactant is used herein which comprises structures of formulas A and B $$(A)\ CH_3(CH_2)_x(CHOSO_3^-M^+)CH_3 \text{ and}$$

$$(B)\ CH_3(CH_2)_y(CHOSO_3^-\ M^+)CH_2CH_3$$

for the 2-sulfate and 3-sulfate, respectively. Mixtures of the 2- and 3-sulfate can be used herein. In formulas A and B, x and (y+1) are, respectively, integers of at least about 6, and can range from about 7 to about 20, preferably about 10 to about 16. M is a cation, such as an alkali metal, ammonium, alkanolammonium, alkaline earth metal, or the like. Sodium is typical for use as M to prepare the water-soluble (2,3) alkyl sulfates, but ethanolammonium, diethanolammonium, triethanolammonium, potassium, ammonium, and the like, can also be used. It is preferred that the secondary (2,3) alkyl sulfates be substantially free (i.e., contain less than about 20%, more preferably less than about 10%, most preferably less than about 5%) of such random secondary alkyl sulfates.

The preparation of the secondary (2,3) alkyl sulfates of the type useful herein can be carried out by the addition of $H_2SO_4$ to olefins. A typical synthesis using α-olefins and sulfuric acid is disclosed in U.S. Pat. No. 3,234,258, Morris, or in U.S. Pat. No. 5,075,041, Lutz, granted Dec. 24, 1991, both of which are incorporated herein by reference. The synthesis, conducted in solvents which afford the secondary (2,3) alkyl sulfates on cooling, yields products which, when purified to remove the unreacted materials, randomly sulfated materials, unsulfated by-products such as $C_{10}$ and higher alcohols, secondary olefin sulfonates, and the like, are typically 90+% pure mixtures of 2- and 3-sulfated materials (up to 10% sodium sulfate is typically present) and are white, non-tacky, apparently crystalline, solids. Some 2,3-disulfates may also be present, but generally comprise no more than 5% of the mixture of secondary (2,3) alkyl mono-sulfates. Such materials are available as under the name "DAN", e.g., "DAN 200" from Shell Oil Company.

If increased solubility of the "crystalline" secondary (2,3) alkyl sulfate surfactants is desired, the formulator may wish to employ mixtures of such surfactants having a mixture of alkyl chain lengths. Thus, a mixture of $C_{12}$–$C_{18}$ alkyl chains will provide an increase in solubility over a secondary (2,3) alkyl sulfate wherein the alkyl chain is, say, entirely $C_{16}$. The solubility of the secondary (2,3) alkyl sulfates can also be enhanced by the addition thereto of other surfactants such as the material which decreases the crystallinity of the secondary (2,3) alkyl sulfates. Such crystallinity-interrupting materials are typically effective at levels of 20%, or less, of the secondary (2,3) alkyl sulfate.

Hydrotrope

The granular detergent composition of the present invention preferably includes a hydrotrope such a those commonly used in liquid detergents. It has been found that the inclusion of a hydrotrope into the agglomerated detergent composition described herein surprisingly aides in solubilization of detergent agglomerates which are rich in sulfated surfactants (i.e. >30% of the surfactant system). The hydrotrope regardless of form (i.e. solid, liquid or paste) is mixed with the surfactant paste prior to, or during the agglomeration step. Those skilled in the art will appreciate the wide variety of hydrotropes useful for the instant detergent composition. As mentioned previously, however, the hydrotrope used herein is preferably selected from the group consisting of sulfyl succinates, xylene sulfonates, cumene sulfonates and mixtures thereof. Most preferred are the sodium salts of the aforementioned preferred hydrotropes such as sodium sulfyl succinate. Other suitable hydrotropes include napthalene sulfonates, benzoates, salicylates, gallates, hydroxy naphthoates, picolinates. These and other suitable hydrotropes for use herein are described in known texts such as Mitijevic, "Surface and Colloid Science" Plenum Press, vol 15 (1993), the disclosure of which is incorporated herein by reference.

Builder

The detergent composition of the invention also includes a detergency builder material to assist in controlling mineral hardness. Inorganic as well as organic builders can be used. Builders are typically used in fabric laundering compositions to assist in the removal of particulate soils. Inorganic detergent builders include, but are not limited to, the alkali metal, ammonium and alkanolammonium salts of phytic acid, silicates, carbonates (including bicarbonates and sesquicarbonates), sulphates, and aluminosilicates.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}\cdot yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crisping agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973. Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y]\cdot xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}]\cdot xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene- 2,4,6-trisulphonic acid, and carboxmethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used, however, in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan.28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986. Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

Adjunct Surfactants

One or more adjunct surfactants may be included generally at a level of from about 1% to about 50% of the surfactant system described herein. Nonlimiting examples of surfactants useful in conjunction with the surfactants described herein are the $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates "AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. The N-propyl through N-hexyl $C_{12}$–$C_{18}$ glucamides can be used for low sudsing. $C_{10}$–$C_{21}$) conventional soaps may also be used. If high sudsing is desired, the branched-chain $C_{10}$–$C_{16}$ soaps may be used.

Also included in the surfactant system is the conventional $C_{11}$–$C_{18}$ alkyl benzene sulfonates (also referenced herein as "LAS). While the biodegradability of the so-called "LAS" surfactants have been the subject of some concern, the surfactant system herein may include an optimum level, from about 0.1% to about 15% and more preferably froin about 3% to about 8% by weight, for improving the overall solubility of the detergent composition without substantially decreasing the overall biodegradability of the present detergent composition. Alternatively, the level of LAS may be included as from about 1% to about 40%, more preferably from about 10% to about 25%, by weight of the surfactant system in the detergent composition.

The surfactant system may also include an amine oxide surfactant. Nonlimiting examples include $C_{10-18}$ amine oxides, secondary amine oxides such as dimethyl amine oxide, and tertiary amine oxides having the general formula RR'R"NO in which R is a primary alkyl group containing 8 to 24 carbon atoms; R' is methyl, ethyl, or 2-hydroxyethyl; and R" is independently selected from methyl, ethyl, 2-hydroxyethly and primary alkyl groups containing 8 to 24 carbon atoms. Additionally, the tertiary amine oxide surfactant may be in hydrated form and have the general formula RR'R"NO $nH_2O$ wherein R, R' and R" are the same as above and n is 1 or 2. Examples of other tertiary amines suitable for use herein include those containing one or two short-chain groups independently selected from methyl, ethyl, and 2-hydroxyethyl groups, with the remaining valences of the amino nitrogen being satisfied with long-chain groups independently selected from primary alkyl groups containing 8–24 carbons, e.g., octyl, decyl, dodecyl, tetradecyl, hexadecyl, octadecyl, eicosyl, docosyl, and tetracosyl groups. The primary alkyl groups may be branched-chain groups, but the preferred amines are those in which at least most of the primary alkyl groups have a straight chain.

Exemplary of these tert-amines are N-octyldimethylamine, N,N-didecylmethylamine, N-decyl-N-dodecylethylamine, N-dodecyldimethylamine, N-tetradecyldimcthylamine, N-tetradecyl-N-ethylmethylamine, N-tetradecyl-N-ethyl-2-hydroxyethylamine, N,N-di-tetradecyl-2-hydroxyethylamine, N-hexadecyldimethylamine, N-hexadecyldi- 2- hdroxyethylamine N-octadecyldimethylamine, N,N-dieicosylethylamine, N-docosyl-N-2-hydroxyethylmethylamine, N-tetracosyldimethylamine, etc.

Additional amine oxide surfactants and methods of making the same, all of which are suitable for use herein, are disclosed by Borland et al, U.S. Pat. No. 5,071,594 and Tosaka et al, U.S. Pat. No. 5,096,621, incorporated herein by reference.

Mixtures of anionic and nonionic surfactants are especially useful. Other conventional useful surfactants are listed in standard texts.

Detergent Adjunct Ingredients

The detergent composition can also include any number of additional ingredients. These include detergency builders, bleaches, bleach activators, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference. Also, fabric conditioning agents may be included as an adjunct material such as those described in U.S. Pat. No. 4,861,502, issued Aug. 29, 1989 to Caswell, incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Suitable examples of proteases are the *subtilisins* which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the trade names ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issncd Mar. 6. 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander) suitable cellulases are also disclosed in GB-A-2.075.028; GB-A-2.095.275 and DE-OS-2.247.832.

Suitable lipase enzymes for detergent usage include those produced by microorganisms of the Pseudomonas group, such as Pseudomonas stutzeri ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex Pseudomonas gladioli. The LIPOLASE enzyme derived from Humicola lanuginosa and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to prevent substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued August 17, 1971 to Gedge, et al, and European Patent Application Publication No. 0 199 405, Application No. 86200586.5, published Oct. 29, 1986, Venegas. Enzyme stabilization systems am also described, for example, in U.S. Pat. No. 3,519,570.

Additionally, dye transfer inhibiting agents may also be included, for example, polyvinylpyrrolidone, polyamine N-oxide, copolymers of N-vinylpyrrolidone and N-vinylimidazole are a suitable dye transfer inhibiting polymers for use in the present detergent composition. The level of such additional dye transfer inhibiting agents may vary, but typically will be from about 0.01% to about 10% by weight of the detergent composition.

Agglomeration Process

The following describes exemplifies the agglomeration process by which the detergent composition of the invention is produced. The parameters noted herein are exemplary only and should not be considered as limiting in any way.

Step A—Preparation of Surfactant Paste

The objective is to combine the surfactants and liquid in the compositions into a common mix in order to aid in surfactant solubilization and agglomeration. In this Step, the surfactants and other liquid components including the hydrotrope are mixed together in a Sigma Mixer at 140° F. (60° C.) at about 40 rpm to about 75 rpm for a period of from 15 minutes to about 30 minutes to provide a paste having the general consistency of 20,000–40,000 centipoise. Once thoroughly mixed, the paste is stored at 140° F. (60° C. until agglomeration Step (B) is ready to be conducted.

Step B—Agglomeration of Powders with Surfactant Paste

The purpose of this Step is to transform the base formula ingredients into flowable detergent agglomerates having a mean particle size range of from about 800 microns to about 1600 microns. In this Step, the powders (including materials such as zeolite, citrate, citric acid builder, layered silicate builder (as SKS-6), sodium carbonate, ethylenediaminedisuccinate, magnesium sulfate and optical brightener) are charged into the Eirich Mixer (R-Series) and mixed briefly (ca. 5 seconds–10 seconds) at about 1500 rpm to about 3000 rpm in order to mix the various dry powders fully. The surfactant paste from Step A is then charged into the mixer and the mixing is continued at about 1500 rpm to about 3000 rpm for a period from about 1 minute to about 10 minutes, preferably 1–3 minutes, at ambient temperature. The mixing is stopped when course agglomerates (average particle size 800–1600 microns) are formed.

Step C

The purpose of this Step is to reduce the agglomerates' stickiness by removing/drying moisture and to aid in particle size reduction to the target particle size (in the mean particle size range from about 800 to about 1600 microns, as measured by sieve analysis). In this Step, the wet agglomerates are charged into a fluidized bed at an air stream temperature of from about 41° C. to about 60° C. and dried to a final moisture content of the particles from about 4% to about 10%.

Step D—Coat Agglomerates and Add Free-Flow Aids

The objective in this Step is to achieve the final target agglomerate size range of from about 800 microns to about 1600 microns, and to admix materials which coat the agglomerates, reduce the caking/lumping tendency of the particles and help maintain acceptable flowability. In this Step, the dried agglomerates from Step C are charged into the Eirich Mixer (R-Series) and mixed at a rate of about 1500 rpm to about 3000 rpm while adding 2–6% Zeolite A (median particle size 2–5 μm) during the mixing. The mixing is continued until the desired median particle size is achieved (typically from about 5 seconds to about 45 seconds). At this point, from about 0.1% to about 1.5% by weight of precipitated silica (average particle size 1–3 microns) is added as a flow aid and the mixing is stopped.

In order to make the present invention more readily understood, reference is made to the following examples, which are intended to be illustrative only and not intended to be limiting in scope.

EXAMPLE I

Several detergent compositions (A–C) are made in accordance with the agglomeration process described above. Compositions A and B are within the scope of the invention and composition C is outside of the invention and is presented for purposes of comparison as described in Example II hereinafter. The relative proportions of compositions A–C, in agglomerate form, are listed in Table I below.

| | A % (wt.) | B % (wt.) | C % (wt.) |
|---|---|---|---|
| Component Surfactants | | | |
| $C_{14-15}$ primary alkyl sulfate | 18.8 | 18.8 | 19.2 |
| $C_{12}$–$C_{15}$ alkyl ethoxy (1–3) sulfate | 10.6 | 10.6 | 10.8 |
| Sulfyl succinate (Na) | 2.0 | — | — |
| Xylene sulfonate (Na) | — | 2.0 | — |
| Builders | | | |
| Zeolite 4A | 39.2 | 39.2 | 40.0 |
| Carbonate (Na) | 15.8 | 15.8 | 16.1 |
| Additives | | | |
| Misc. (water, perfume and minors) | 13.6 | 13.6 | 13.9 |
| | 100.0 | 100.0 | 100.0 |

EXAMPLE II

This Example illustrates the surprisingly improved solubility achieved by the detergent composition of the invention. Specifically, standard dosages of compositions A–C (1170 ppm) are dissolved in an aqueous laundering solution having a water temperature of 10° C. and a water hardness of 7 grains/gallon (Ca:Mg ratio of 3:1). The laundering solution is continuously agitated at a rate of 75 rpm and samples of the wash solution were taken at various time intervals as shown in Table I below. For purposes of illustrating the improved solubility of the detergent composition according to the invention, the amount of surfactant in the laundering solution is determined by conducting the well known "cat$SO_3$" titration technique on the samples taken from individual wash solutions containing one of the compositions A–C. In particular, the amount of anionic surfactant in the laundering solution is determined by filtering the samples through 0.45 nylon filter paper to remove the insolubles and thereafter, titrating the filtered solution to which anionic dyes (dimidium bromide) have been added with a cationic titrant such as Hyamine™ commercially available from Sigma Chemical Company. Accordingly, the relative amount of anionic surfactant dissolved in the wash solution can be determined. This technique is well known and others may be used if desired. The results are shown in Table II below.

TABLE II

| | (% total of anionic dissolved) | | |
|---|---|---|---|
| Time (Minutes) | A | B | C |
| 0 | 0% | 0% | 0% |
| 1 | 22% | 37% | 22% |
| 3 | 29% | 45% | 34% |
| 10 | 52% | 58% | 34% |

From the results in Table II, it is quite clear that compositions A and B which are within the scope of the invention surprisingly have improved solubility over composition C which is outside the scope of the invention.

EXAMPLE III

Several laundry bars, D and E, suitable for hand-washing soiled fabrics are prepared by standard extrusion processes and comprise the following ingredients listed in Table III:

TABLE III

| | D % (wt.) | E % (wt.) |
|---|---|---|
| Component Surfactants | | |
| $C_{14-15}$ primary alkyl sulfate | 18.8 | 18.8 |
| $C_{12}$–$C_{15}$ alkyl ethoxy (1–3) sulfate | 10.6 | 10.6 |
| Sulfyl succinate (Na) | 2.0 | — |
| Xylene sulfonate (Na) | — | 2.0 |
| Builders | | |
| Zeolite 4A | 39.2 | 39.2 |
| Carbonate (Na) | 15.8 | 15.8 |
| Additives | | |
| Misc. (water, perfume and minors) | 13.6 | 13.6 |
| | 100.0 | 100.0 |

Having thus described the invention in detail, it will be obvious to those skilled in the art that various changes may be made without departing from the scope of the invention and the invention is not to be considered limited to what is described in the specification.

What is claimed is:

1. A detergent composition having a density of at least 650 g/l comprising:

(a) from about 1% to about 50% by weight of a detersive surfactant system comprising at least about 30%, by weight of said surfactant system, of a sulfated surfactant selected from the group consisting of $C_{10-20}$ alkyl sulfates, $C_{10-18}$ alkyl ethoxy sulfates having from about 1 to about 7 ethoxy groups, secondary alkyl sulfates and mixtures thereof;

(b) from about 1% to about 50%by weight of a hydrotrope which is sodium sulfyl succinate; and (c) at least about 1% by weight of a detergency builder; wherein said surfactant system, said hydrotrope and said builder are agglomerated to form detergent agglomerates which are substantially free of phosphates; wherein said sulfated surfactant has improved solubility in an aqueous laundering solution.

2. The detergent composition of claim 1 wherein said secondary alkyl sulfate surfactant is a secondary (2,3) alkyl sulfate.

3. The detergent composition of claim 1 wherein said sulfated surfactant is a mixture of alkyl sulfate and alkyl ethoxy sulfate surfactants.

4. The detergent composition of claim 1 wherein said detergency builder is in an amount from about 10% to about 40% by weight.

5. The detergent composition of claim 1 wherein said detergency builder is selected from the group consisting of sodium carbonate, zeolites and mixtures thereof.

6. The detergent composition of claim 1 wherein said surfactant system further comprises, by weight of said surfactant system, from about 1% to about 50% by weight of a $C_{10}$–$C_{18}$ N-alkyl polyhydroxy fatty acid amide for use as an adjunct surfactant.

7. The detergent composition of claim 1 further comprising from about 0.1% to about 15% by weight of a $C_{11-18}$ linear alkylbenzene sulfonate surfactant.

8. The detergent composition of claim 1 wherein said sulfate surfactant in said detergent composition is at least 5% more soluble in said aqueous laundering solution as compared to said sulfate surfactant dissolved alone in said aqueous laundering solution.

9. The detergent composition of claim 1 wherein said laundering solution is at a temperature from about 5° C. to about 30° C.

10. A method for laundering soiled fabrics comprising the step of contacting said soiled fabrics with an effective amount of a detergent composition according to claim 1 in an aqueous laundering solution.

* * * * *

UNITED STATES PATENT AND TRADEMARK OFFICE

CERTIFICATE OF CORRECTION

PATENT NO. : 5,478,502

DATED : December 26, 1995

INVENTOR(S) : Ronald A. Swift

It is certified that error appears in the above-identified patent and that said Letters Patent is hereby corrected as shown below:

On the cover page: Item [54], line 3, and Column 1, line 3, change "ANOIONIC" to --ANIONIC --.

In Column 1, line 21, change "or" to --of--.

In Column 4, line 66, change "tinder" to --under--.

In Column 5, line 52, change "m+n" to --m + n--.

In Column 8, line 18, change "1,3,5-trihydroxy" to --1, 3, 5-trihydroxy--.

In Column 8, line 19, change "2,4,6-trisulphonic" to --2, 4, 6-trisulphonic--.

In Column 8, line 19, change "carboxmethyloxysuccinic" to --carboxymethyloxysuccinic--.

In Column 9, line 4, change "ethoxylates "AE")" to --ethoxylates ("AE")--.

In Column 9, line 20, change "froin" to --from--.

In Column 9, lines 53-54, change "N-tetradecyldimcthylamine" to --N-tetradecyldimethylamine--.

In Column 11, line 36, change "prevent" to --other--.

In Column 14, line 45, change "50%by" to --50% by--.

Signed and Sealed this

Twentieth Day of August, 1996

*Attest:*

BRUCE LEHMAN

*Attesting Officer*

*Commissioner of Patents and Trademarks*